US010563624B2

(12) United States Patent
Sugimoto et al.

(10) Patent No.: US 10,563,624 B2
(45) Date of Patent: Feb. 18, 2020

(54) EXHAUST GAS HEAT EXCHANGER HAVING STACKED FLAT TUBES

(71) Applicant: T.RAD Co., Ltd., Tokyo (JP)

(72) Inventors: Hirohito Sugimoto, Tokyo (JP); Etsuo Yamamoto, Tokyo (JP)

(73) Assignee: T.RAD Co., Ltd., Tokyo (JP)

( * ) Notice: Subject to any disclaimer, the term of this patent is extended or adjusted under 35 U.S.C. 154(b) by 40 days.

(21) Appl. No.: 16/068,716

(22) PCT Filed: Jan. 11, 2017

(86) PCT No.: PCT/JP2017/001618
§ 371 (c)(1),
(2) Date: Jul. 9, 2018

(87) PCT Pub. No.: WO2017/122832
PCT Pub. Date: Jul. 20, 2017

(65) Prior Publication Data

US 2019/0017471 A1 Jan. 17, 2019

(30) Foreign Application Priority Data

Jan. 12, 2016 (JP) ..... 2016-003809

(51) Int. Cl.
*F28F 9/02* (2006.01)
*F02M 26/32* (2016.01)
(Continued)

(52) U.S. Cl.
CPC ..... *F02M 26/32* (2016.02); *F28D 1/053* (2013.01); *F28D 7/0075* (2013.01);
(Continued)

(58) Field of Classification Search
CPC ..... F02M 26/32; F28D 7/0041; F28D 1/053; F28D 7/0075; F28D 7/1684;
(Continued)

(56) References Cited

U.S. PATENT DOCUMENTS 8,651,170 B2 * 2/2014 Maeda ..... F28D 7/0041 165/152
2003/0010479 A1 1/2003 Hayashi et al.

FOREIGN PATENT DOCUMENTS

JP 2003-090693 A 3/2003
JP 2005-069064 A 3/2005
(Continued)

*Primary Examiner* — Davis D Hwu
(74) *Attorney, Agent, or Firm* — Norris McLaughlin, P.A.

(57) ABSTRACT

An exhaust gas heat exchanger having stacked flat tubes includes a stacked tube body configured by stacking a plurality of flat tubes in multiple tiers with spaces therebetween and arranged inside a case; exhaust gas flows in from a first end part of the stacked tube body in a tube axis direction, circulates through each flat tube, and flows out from the a second end part; and cooling water from the case is supplied to the first end part to circulate along an exterior surface side of each flat tube. The cooling water is introduced into the tubes from two locations of the case and in mutually opposite directions which are parallel to flat surfaces of the tubes and vertical in the axis direction of the flat tubes.

9 Claims, 5 Drawing Sheets

(51) Int. Cl.

| | |
|---|---|
| ***F28F 1/02*** | (2006.01) |
| ***F28D 7/00*** | (2006.01) |
| ***F28F 9/00*** | (2006.01) |
| ***F28F 9/22*** | (2006.01) |
| ***F28D 1/053*** | (2006.01) |
| ***F28D 7/16*** | (2006.01) |
| ***F28D 21/00*** | (2006.01) |
| *F01N 5/02* | (2006.01) |

(52) U.S. Cl.
CPC ..... *F28D 7/1684* (2013.01); *F28D 21/0003* (2013.01); *F28F 1/022* (2013.01); *F28F 1/025* (2013.01); *F28F 9/001* (2013.01); *F28F 9/0265* (2013.01); *F28F 9/0278* (2013.01); *F28F 9/22* (2013.01); *F01N 5/02* (2013.01); *F28D 2021/008* (2013.01); *F28F 2001/027* (2013.01)

(58) Field of Classification Search
CPC ..... F28D 21/0003; F28D 2012/008; F28F 1/022; F28F 1/025; F28F 9/001; F28F 9/0265; F28F 9/0278; F28F 9/22; F28F 2001/027; F01N 5/02
USPC ..... 165/158
See application file for complete search history.

(56) References Cited

FOREIGN PATENT DOCUMENTS

| | | | |
|---|---|---|---|
| JP | 2007-154683 | A | 6/2007 |
| JP | 4386215 | B2 | 12/2009 |
| JP | 2010-090785 | A | 4/2010 |
| JP | 2013-053620 | A | 3/2013 |
| JP | 2014-194296 | A | 10/2014 |
| WO | 2009/046956 | A1 | 4/2009 |

* cited by examiner

EXHAUST GAS HEAT EXCHANGER HAVING STACKED FLAT TUBES

BACKGROUND OF THE INVENTION

The present invention relates to an exhaust gas heat exchanger having stacked flat tubes such as an EGR cooler, in which boiling of cooling water inside a case is suppressed.

In order to reduce nitrogen oxide (NOx) contained in exhaust gas exhausted from an engine of a vehicle or the like, or to reduce pumping loss, to mount an EGR (Exhaust Gas Recirculation) device on a vehicle is generally performed. In many cases, in order to lower combustion temperatures in the engine, for this EGR device, an EGR cooler, which is a kind of an exhaust gas heat exchanger and for cooling the exhaust gas, is provided, in a line through which a part of the exhaust gas is recirculated to an intake side of the engine.

A general EGR cooler includes a stacked tube body arranged inside a case; the cooler configured such that exhaust gas flows in from one end part of a stacked tube body in a tube axis direction to circulate through the inside of respective flat tubes and flow out from the other end part; and cooling water introduced from a cooling water introduction part provided for the case is supplied to the above-described one end part and circulates through an outer surface side of respective flat tubes.

In the EGR cooler configured as described above, exhaust gas having flowed in from one end part of the stacked tube body in the tube axis direction is cooled, while circulating through the inside of respective tubes and flowing out from the other end part, with cooling water circulating in the same direction as the exhaust gas through the outer surface side of the tube. The exhaust gas in the EGR cooler has the highest temperature at a part at which the exhaust gas flows into the stacked tube body (one end part of the above-described stacked tube body in the tube axis direction), and the temperature gradually falls due to heat exchange with the cooling water while the exhaust gas circulates through the inside of respective tubes to become the lowest at the part where it flows out from the stacked tube body (the other end part of the above-described stacked tube body in the tube axis direction).

However, usually, a cooling water introduction part is provided at a corner part on one side of a case, and cooling water that flows in from the introduction part and flows through a gap between respective tubes causes easily drift in which the cooling water flows disproportionately to a part with low flow resistance rather than a part with high flow resistance and tends not to be distributed evenly to a cooling water inflow part of respective tubes. In general, presence of difference in distances from a cooling water introduction part provided at a corner part on one side of a case to each position of cooling water inflow parts of a stacked tube body is a main factor of the difference in flow resistances. Then, when viewed from the entire stacked tube body, temperature in a part of a stacked tube body near the inflow part of exhaust gas is made high, and cooling water in a part in which a flow quantity is reduced due to drift easily generates in particular local boiling.

In order to suppress such local boiling of cooling water, installation of a cooling water supply chamber, which has an effect of causing cooling water distribution to a stacked tube body to be uniform, is proposed. For example, in Patent Literature 1, a device is disclosed, in which an annular cooling water supply chamber is externally mounted on one end part of a peripheral wall of a case and an inlet tube is connected to the cooling water supply chamber, and, in addition, an annular slit hole interconnecting the inside of the cooling water supply chamber and the inside of the case is oriented toward a case part inside the cooling water supply chamber.

Moreover, in Japanese Patent Application Laid-Open Publication No. 2005-69064, installation of a cooling water supply chamber having a shape different from that in the Japanese Patent Application Laid-Open Publication No. 2007-154683 is disclosed. In the cooling water supply chamber in Japanese Patent Application Laid-Open Publication No. 2005-69064, the tip part thereof is connected to a cooling water inlet tube, and the end part is interconnected to a case housing a stacked tube body. Width of the cooling water supply chamber is gradually expanded from the cooling water inlet tube side toward the case side, and the expanded end part coincides with a case width of a part housing the stacked tube body. Consequently, it is so configured that cooling water can be supplied uniformly over the entire case width.

SUMMARY OF THE INVENTION

As a consequence of installation of such a cooling water supply chamber system, an effect of suppressing boiling of cooling water in the inside of a case of an EGR cooler can be sufficiently expected. However, due to the installation of the cooling water supply chamber system outside the case of an EGR cooler, new problems are generated such that the entire configuration of the EGR cooler becomes complex in accordance with the installation and, in addition, a loading volume of a vehicle, whose space is strictly restricted, is increased to also increase the cost.

The present invention is configured as follows, in order to solve the above-described problems. That is, a first invention of the present invention is an exhaust gas heat exchanger having stacked flat tubes including:

a stacked tube body configured by stacking a plurality of flat tubes in multiple tiers with spaces therebetween and arranged inside a case; the exchanger configured such that exhaust gas flows in from one end part of the stacked tube body in a tube axis direction, circulates through an inside of each flat tube, and flows out from the other end part; and cooling water introduced from a cooling water introduction part provided for the case is supplied to the one end part to circulate along an exterior surface side of each flat tube, wherein the cooling water introduction parts are provided in two locations for the case and introduction directions of the cooling water from each of the cooling water introduction parts into the inside of the case are set in mutually opposite directions; and wherein each of the introduction directions is parallel to a flat surface of the flat tube in the stacked tube body and vertical in the axis direction of the flat tube.

A second invention of the present invention is the exhaust gas heat exchanger having stacked flat tubes according to the first invention, wherein each of the two cooling water introduction parts is provided with a baffle plate having cutout parts; the exchanger configured such that the introduced cooling water passes through these cutout parts and is distributed to one end part of the stacked tube body in the tube axis direction.

A third invention of the present invention is the exhaust gas heat exchanger having stacked flat tubes according to the second invention, wherein the two baffle plates are configured such that respective distribution main portions of the cooling water flow toward mutually different spaces between layers of the stacked tube body.

A fourth invention of the present invention is the exhaust gas heat exchanger having stacked flat tubes according to the second or third invention, wherein the two baffle plates are structured integrally with a linking plate having an opening part that allows exhaust gas to circulate.

A fifth invention of the present invention is the exhaust gas heat exchanger having stacked flat tubes according to the fourth invention, wherein at least one of the two baffle plates has a receiving surface for receiving the cooling water introduced into the cooling water introduction parts, and a guide surface for guiding the cooling water from the receiving surface to the cutout parts.

A sixth invention of the present invention is the exhaust gas heat exchanger having stacked flat tubes according to the fifth invention, wherein a folding erection part is provided for an end part of the receiving surface lying on the opposite side of the guide surface; the exchanger configured such that the folding erection part prevents the cooling water from flying in all directions from the receiving surface and flowing out into the inside of the case.

In the first invention, the cooling water introduction part is provided for a case in two locations, introduction directions of cooling water from respective cooling water introduction parts into the inside of the case are opposite to each other and, in addition, each introduction direction is parallel to a flat surface of the flat tube in the stacked tube body and is perpendicular in the axis direction of the flat tube.

As a consequence of the configuration as described above, the cooling water is introduced in opposition from both directions (horizontal directions) parallel to the flat surface of the flat tube in the stacked tube body and perpendicular in the axis direction of the stacked tube body that is coaxial with the circulation direction of exhaust gas and, therefore, the cooling water is uniformly distributed (divided in flow amount) over the entire one end part in the stacked tube body, without drift toward one side of the right and left of the stacked tube body. As a result, local boiling of the cooling water can effectively be suppressed. Moreover, since installation of a cooling water supply chamber system outside the case is unnecessary unlike the conventional structure, problems such as complication of entire configuration, increase in a loading capacity and/or increase in cost are not generated.

In the second invention, the configuration is such that a baffle plate having a cutout part is provided for each of the two cooling water introduction parts and introduced cooling water passes through these cutout parts and distributed to one end part of the stacked tube body in the tube axis direction.

As a consequence of the configuration as described above, by setting the shape and/or position of the cutout part of the baffle plate as intended, the optimum distribution of the cooling water in accordance with characteristics and/or structure of an exhaust gas heat exchanger can be set. As a result, the optimum setting, by which drift tending to occur in the cooling water flow from the cutout part toward the stacked tube body side is suppressed as far as possible and even and sufficient amount of cooling water can be supplied to the one end part in the stacked tube body, becomes possible to thereby suppress a local boiling phenomenon.

The third invention is configured such that respective distribution main portions (respective parts with a large distribution percentage) of the cooling water with respect to the two baffle plates flow toward mutually different spaces between layers of the stacked tube body.

As a consequence of the configuration as described above, the cooling water that flow out so as to be opposite mutually from cutout parts of the two baffle plates do not interfere with each other at the center part of one end part of the stacked tube body in the axis direction to prevent a phenomenon of reduction of cooling water flow rate that would be generated due to the interference. As a result, local boiling of the cooling water due to flow rate reduction is also avoided.

The fourth invention of the present invention is configured such that the two baffle plates are structured integrally with a linking plate. As a consequence of the configuration as described above, positioning and provisional fixing of the baffle plate become unnecessary in assembling an exhaust gas heat exchanger, and simple and highly accurate installation of the baffle plate becomes possible.

The fifth invention of the present invention is configured such that at least one of the two baffle plates has a receiving surface for receiving cooling water introduced into the cooling water introduction part, and a guide surface for guiding the cooling water from the receiving surface to the cutout part. As a consequence of the configuration as described above, cooling water introduced from the cooling water introduction part is received with the receiving surface and, via the guide surface smoothly, guided surely to the cutout part, and distributed to one end part (upstream side of exhaust gas) of the stacked tube body in the axis direction.

The sixth invention of the present invention is configured such that a folding erection part is provided for the end part on the side opposite to the guide surface in the receiving surface and, with the folding erection part, the cooling water is prevented from flying in all directions from the receiving surface and flowing out inside the case. As a consequence of the configuration as described above, outflow of a part of the cooling water, which is introduced from the cooling water introduction part, from the baffle plate into the inside of the case without passing through the cutout part is suppressed, and all the cooling water having flowed in is surely guided to the cutout part, which is distributed from there to the one end part of the stacked tube body in the axis direction.

DETAILED DESCRIPTION OF THE INVENTION

Figure 1:
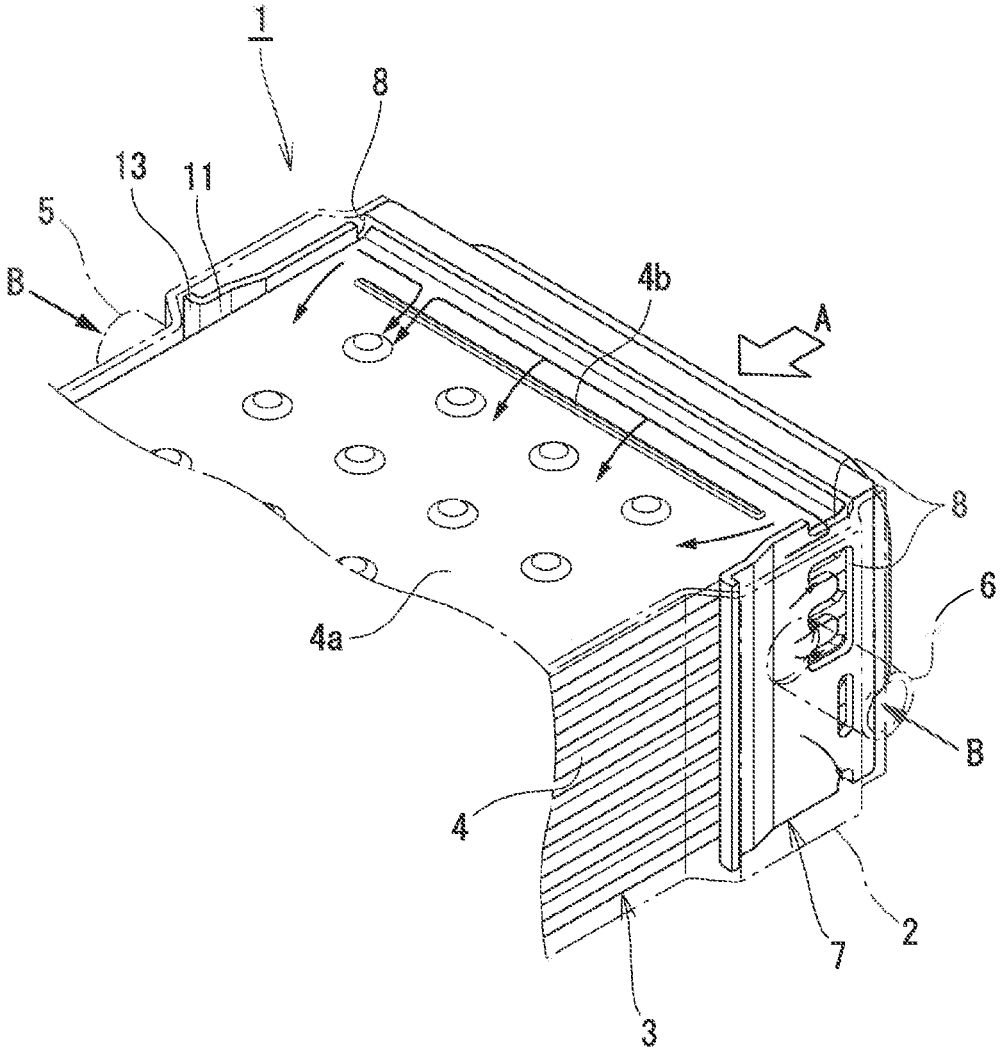
FIG. 1 illustrates a partial perspective view showing the inside of one end part of a stacked tube body in an axis direction in an EGR cooler that is a type of an exhaust gas heat exchanger of the present invention.
Figure 2:
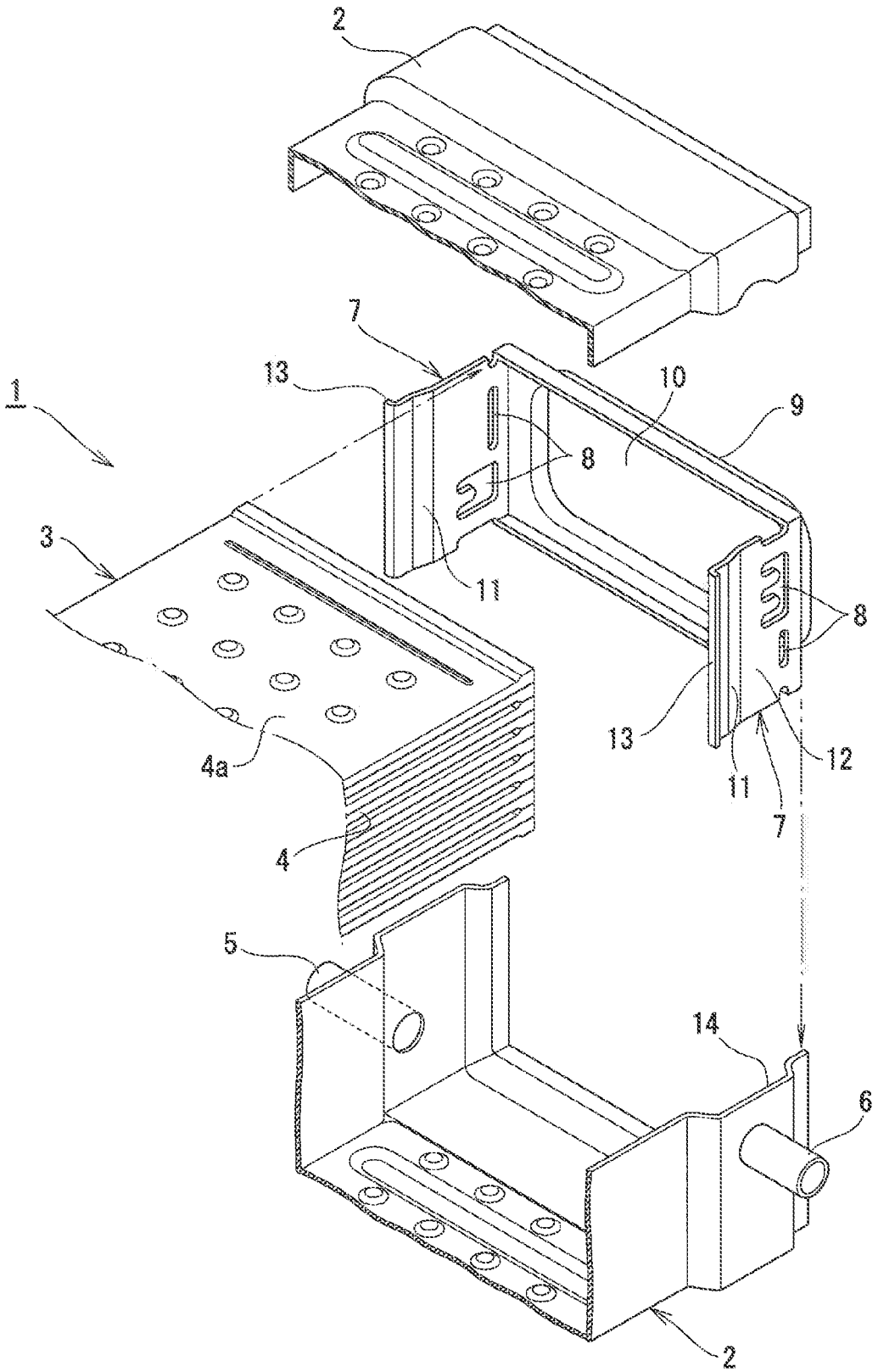
FIG. 2 illustrates a partial perspective view of a disassembled one end part of the stacked tube body in the axis direction shown in FIG. 1.

FIG. 1 illustrates a partial perspective view showing the inside of one end part of a stacked tube body in an axis direction in an EGR cooler that is a type of an exhaust gas heat exchanger of the present invention, and FIG. 2 illustrates a partial perspective view of a disassembled one end part of the stacked tube body in the axis direction shown in FIG. 1. In these drawings, an EGR cooler 1 includes a long and thin case 2 having an approximately square cross-section, and a long and thin stacked tube body 3 having an approximately square cross-section housed inside the case 2.

The stacked tube body 3 is configured by stacking a plurality of flat tubes 4 in multiple tiers with spaces therebetween. Each of flat tubes 4 is stacked in multiple tiers with a predetermined space each other in the vertical direction in FIG. 1, and each of upper and lower surfaces of each flat tube 4 configures a flat surface 4*a*.

Exhaust gas A at a high temperature is supplied into the case 2 in the axis direction from the arrow direction and flows into the stacked tube body 3 in the axis direction. Specifically, the exhaust gas A flows in from one end part of the long and thin stacked tube body 3 in the axis direction, circulates through the inside of each flat tube 4 in the axis direction and flows out from the other end part. It is configured such that, to the case 2 at one end part of the stacked tube body 3 in the axis direction, that is, at one end part lying on a side where the exhaust gas A at high temperature flows in, cooling water B introduced from two cooling water introduction parts 5 and 6 is distributed.

The cooling water introduction part 5 is provided for a right sidewall of the case 2 in FIG. 1, and the cooling water introduction part 6 is provided for a left sidewall of the case 2 in FIG. 1. Introduction directions of the cooling water introduced from each of the cooling water introduction parts 5 and 6 are directions opposite to each other and, moreover, each of the introduction directions is parallel to the flat surface 4*a* of the flat tube 4 in the stacked tube body 3 and perpendicular in the axis direction of the flat tube 4. In FIG. 1, cooling water is introduced horizontally from the cooling water introduction part 5 on the right side in the left direction in FIG. 1, and cooling water is introduced horizontally from the cooling water introduction part 6 on the left side in the right direction in FIG. 1. Then, cooling water distributed to one end of the long and thin stacked tube body 3 in the axis direction circulates in the axis direction along the outer surface side of each flat tube 4 and flows out from the other end part.

For each of the cooling water introduction parts 5 and 6 in this embodiment, baffle plates 7 having cutout parts 8 are provided. As shown in FIG. 2, two baffle plates 7 are formed in a plate shape and, in the inside thereof, a plurality of cutout parts 8 (detailed action thereof will be described later) are formed. Further, the cooling water introduction parts 5 and 6 are linked integrally with a linking plate 9 so that the plate surfaces of the cooling water introduction parts 5 and 6 face each other, and an opening part 10 that allows the exhaust gas A to pass through is provided in the linking plate 9. Incidentally, two baffle plates 7 linked integrally with the linking plate 9 are joined integrally with the case 2 by brazing or the like.

As shown in FIG. 2, in the baffle plate 7, a receiving surface 11 that receives cooling water introduced to the cooling water introduction parts 5 and 6 and a guide surface 12 that guides the cooling water received with the receiving surface 11 to the cutout part 8 are formed. The receiving surface 11 is formed of a surface perpendicular in the introduction direction of cooling water, and the guide surface 12 is formed of a moderately inclined surface inclining from the receiving surface 11 in an obtuse angle direction. On the end part on the side opposite to the guide surface 12 in the receiving surface 11, a folding erection part 13 whose linear long and thin tip edge is in close contact with the inner surface of the case 2 is provided, and, with the folding erection part 13, cooling water is prevented from flying in all directions from the receiving surface 11 and flowing out into the inside of the case 2. Incidentally, the folding erection part 13 is formed by folding an end part of the receiving surface 11.

On the other hand, as shown in FIG. 2, in a part overlapping the cooling water introduction parts 5 and 6 in the case 2 facing the baffle plate 7, an evagination part 14 that evaginates outward is formed, and cooling water is introduced perpendicularly to the evagination part 14 and collides perpendicularly with the surface of the receiving surface 11 formed in the baffle plate 7. The cooling water is guided smoothly to the cutout part 8 from the receiving surface 11 along the guide surface 12, and distributed to one end part of the long and thin stacked tube body 3 in the axis direction through the cutout part 8.

Figure 3:
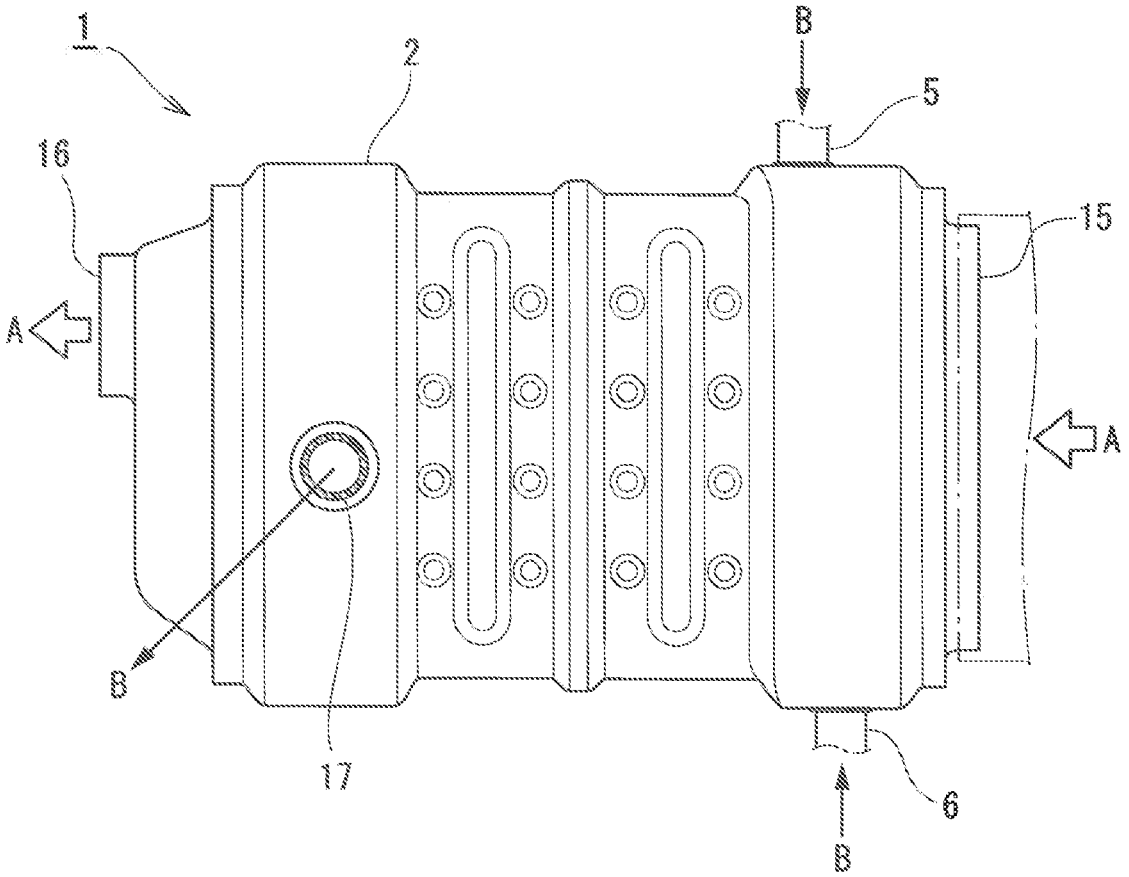
FIG. 3 illustrates an appearance plan view showing the entire EGR cooler in FIG. 1.
Figure 4:
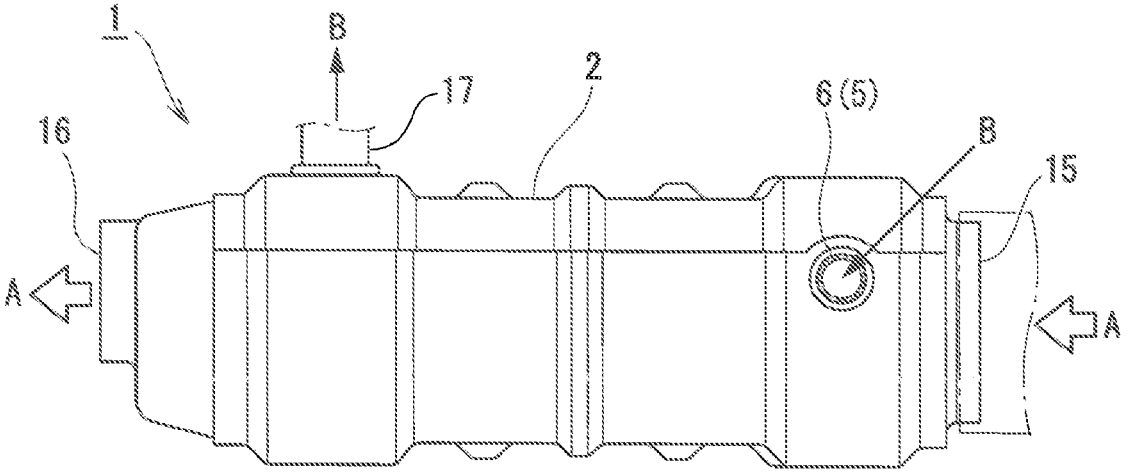
FIG. 4 illustrates an appearance side view showing the entire EGR cooler in FIG. 1.

In FIG. 1 and FIG. 2 one end part alone of the stacked tube body in the axis direction in an EGR cooler is shown, in FIG. 3 an appearance plan view showing the whole of the EGR cooler is shown, and in FIG. 4 an appearance side view thereof is shown. Moreover, in FIG. 5 a plan cross-sectional view showing the inside of FIG. 3 is shown.

Figure 5:
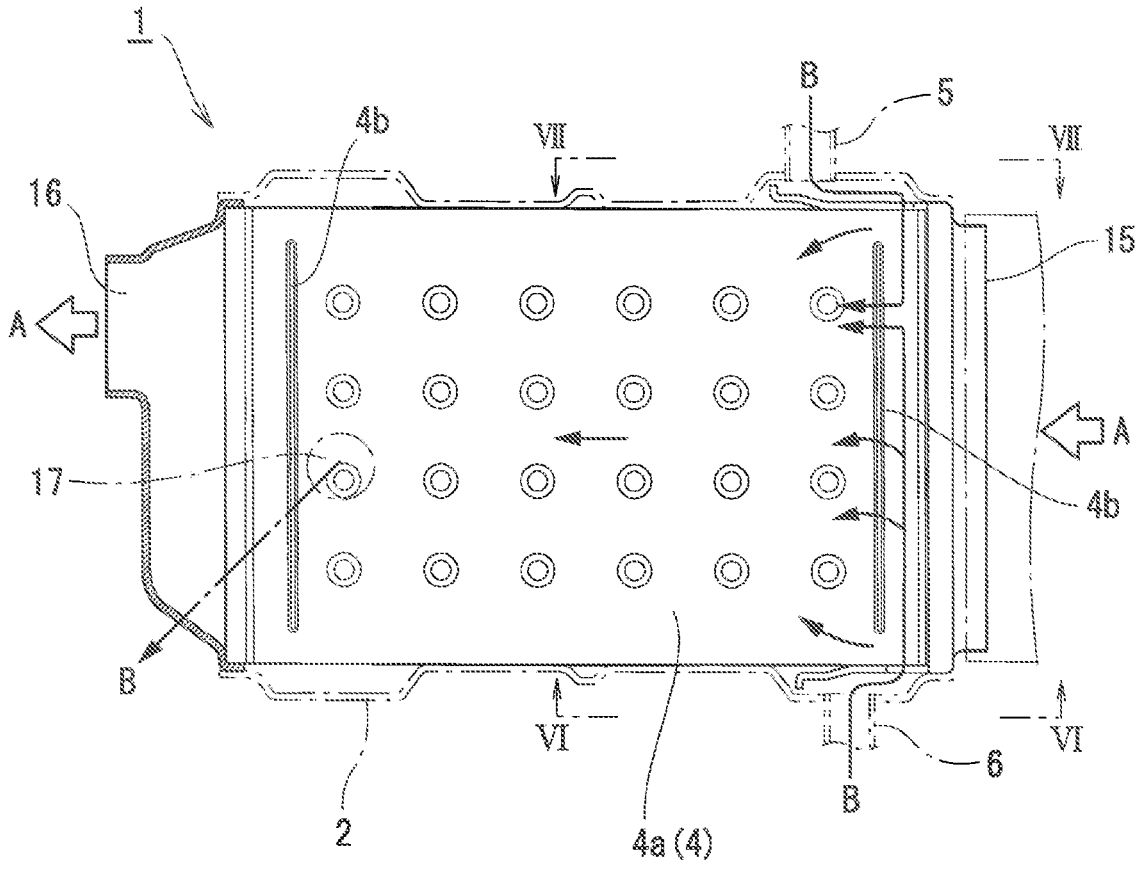
FIG. 5 illustrates a cross-sectional plan view showing the inside in FIG. 3.

In FIGS. 3 to 5, a supply part 15 for the exhaust gas A is provided for one end part in the axis direction of the case 2 provided in the EGR cooler 1, and a discharge part 16 for the exhaust gas A having circulated through the stacked tube body 3 is provided for the other end part. Near the supply part 15 for the exhaust gas A, cooling water supply parts 5 and 6 are provided while facing each other in horizontal directions in FIGS. 3 and 5, and, near the discharge part 16 for the exhaust gas A, a discharge part 17 for a cooling water having passed along the outer periphery of the stacked tube body 3 is provided.

In FIG. 5, in order to show the inside of the case 2, the case 2 is shown with a dashed one-dotted line. In FIG. 5, the surface of the flat surface 4*a* of the flat tube 4 configuring the stacked tube body 3 is shown. On each of one end part and the other end part of each of flat tubes 4 having been stacked, a long and thin linear ribs 4*b* are formed in the vertical direction in FIG. 5 (corresponding to the horizontal direction in FIG. 1). These ribs 4*b* have been conventionally adopted, however, in particular the rib 4*b*, which is formed on the surface of the flat surface 4*a* of one end part into which the exhaust gas A flows, distributes cooling water having been distributed to one tip part to the surface of the flat surface 4*a* as an arrow and enhances the flow rate in the part to thereby reduce local boiling. Incidentally, projection height of the rib 4*b* is set to be lower than flow path height, and a part of the cooling water flows over the rib 4*b*. A situation of distribution of the cooling water due to the rib 4*b* is also shown with an arrow in FIG. 1.

Figure 6:
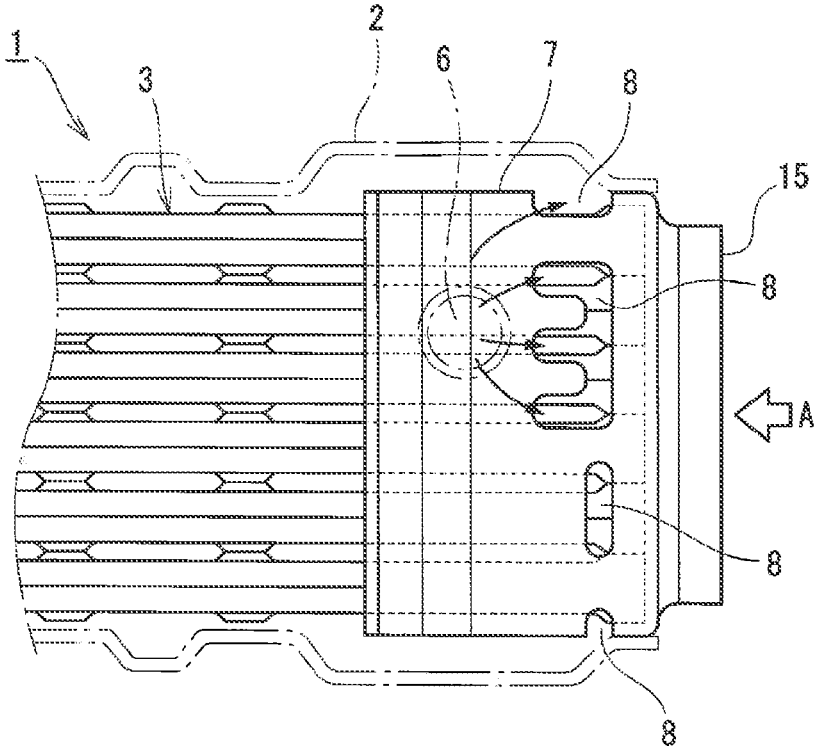
FIG. 6 illustrates a VI-VI arrow view of FIG. 5.
Figure 7:
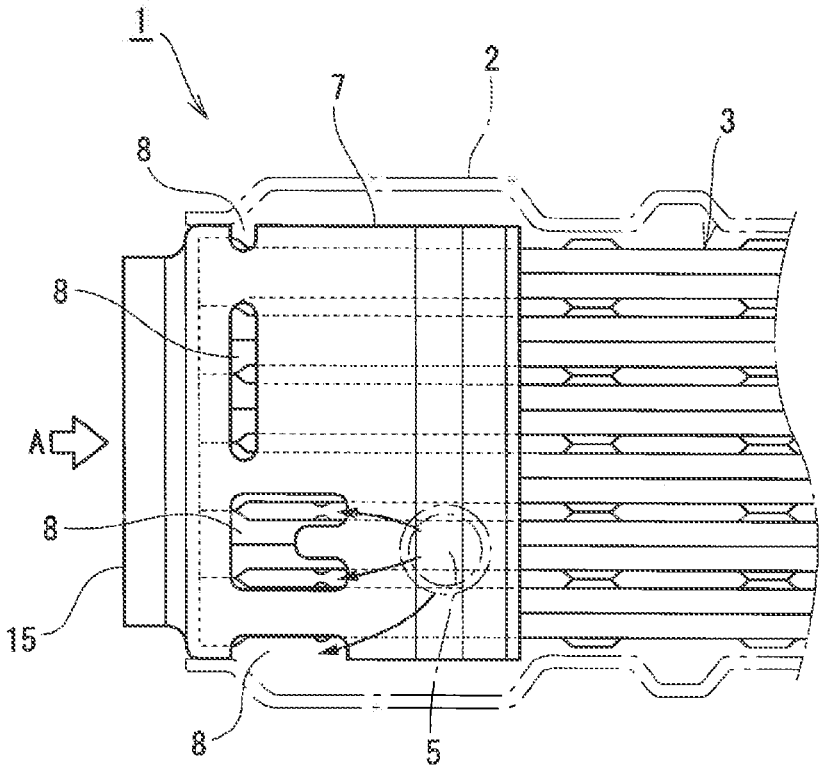
FIG. 7 illustrates a VII-VII arrow view of FIG. 5.

FIG. 6 illustrates a VI-VI arrow view of FIG. 5, and FIG. 7 illustrates a VII-VII arrow view of FIG. 5. With respect to the cutout part 8 in the baffle plate 7 shown in FIG. 6, a cutout part 8 having a comb-teeth-like shape and a comparatively large opening area is formed on the upper side in FIG. 6 and a cutout part 8 having an oval shape and a small opening area is formed on the lower side. The cutout part 8 having a large opening area is mainly for distribution, and a greater part of cooling water passes through the cutout part 8 on the upper side having a little flow resistance and is distributed to the stacked tube body 3. On the other hand, the cutout part 8 having a small opening area is mainly for applying a brazing material to the stacked tube body 3, and has large flow resistance. Therefore, only a small amount of cooling water flows through the cutout part 8 on the lower side. In other words, the baffle plate 7 in FIG. 6 is set so that a greater amount of cooling water is distributed to a flat tube 4 group on the upper side than to a flat tube 4 group on the lower side in the stacked tube body 3 in FIG. 6 and, therefore, the distribution main portions thereof lie on the upper side in spaces between tube layers.

Furthermore, with respect to the cutout part 8 in the baffle plate 7 shown in FIG. 7, a cutout part 8 having a comb-teeth-like shape and a comparatively large opening area is formed on the lower side in the drawing, and a cutout part 8 having an oval shape and a small opening area is formed on the upper side. That is, the baffle plate 7 in FIG. 7 is set so that a greater amount of cooling water is distributed to a flat tube 4 group on the lower side than to a flat tube 4 group on the upper side in the stacked tube body 3 in FIG. 7 and, therefore, the distribution main portions thereof lie on the lower side in spaces between tube layers.

In this way, as a consequence of configuration such that the distribution main portions of each cooling water flow toward spaces between mutually different layers of the stacked tube body, as described above, each cooling water that flows out from the cutout part 8 of two baffle plates 7 so as to face mutually does not interfere mutually at the center part of one end part of the stacked tube body 3 in the axis direction, and, as described above, a phenomenon of flow rate reduction of the cooling water that might occur due to the interference can be warded off to prevent local boiling of the cooling water due to flow rate reduction, as a result.

The exhaust gas heat exchanger of the present invention is utilized as a cooler in a discharge gas recirculation system or a heat exchanger for recover heat of exhaust gas, in a diesel engine or a gasoline engine.

The invention claimed is:

1. An exhaust gas heat exchanger having stacked flat tubes comprising:

a stacked tube body configured by stacking a plurality of flat tubes in multiple tiers with spaces therebetween and arranged inside a case; the exchanger configured such that exhaust gas flows in from one end part of the stacked tube body in a tube axis direction, circulates through an inside of each flat tube, and flows out from the other end part; and cooling water introduced from a cooling water introduction part provided for the case is supplied to the one end part to circulate along an exterior surface side of each flat tube, wherein the cooling water introduction parts are provided in two locations for the case and introduction directions of the cooling water from each of the cooling water introduction parts into the inside of the case are set in mutually opposite directions, and wherein each of the introduction directions is parallel to a flat surface of the flat tube in the stacked tube body and vertical in the axis direction of the flat tube, and each of the two cooling water introduction parts is provided with a baffle plate having cutout parts; the exchanger coil cured such that the introduced cooling, water passes through these cutout parts and is distributed to one end part of the stacked tube body in the tube axis direction.

2. The exhaust gas heat exchanger having stacked flat tubes according to claim 1, wherein the two baffle plates are configured such that respective distribution main portions of the cooling water flow toward mutually different spaces between layers of the stacked tube body.

3. The exhaust gas heat exchanger having stacked flat tubes according to claim 2, wherein the two baffle plates are structured integrally with a linking plate having an opening part that allows exhaust gas to circulate.

4. The exhaust gas heat exchanger having stacked flat tubes according to claim 3, wherein at least one of the two baffle plates has a receiving surface for receiving the cooling water introduced into the cooling water introduction parts, and a guide surface for guiding the cooling water from the receiving surface to the cutout parts.

5. The exhaust gas heat exchanger having stacked flat tubes according to claim 4, wherein a folding erection part is provided for an end part of the receiving surface lying on the opposite side of the guide surface; the exchanger configured such that the folding erection part prevents the cooling water from flying in all directions from the receiving surface and flowing out into the inside of the case.

6. The exhaust gas heat exchanger having stacked flat tubes according to claim 1, wherein the two baffle plates are structured integrally with a liming plate having an opening part that allows exhaust gas to circulate.

7. The exhaust gas heat exchanger having stacked flat tubes according to claim 6, wherein at least one of the two baffle plates has a receiving surface for receiving the cooling water introduced into the cooling water introduction parts, and a guide surface for guiding the cooling water from the receiving surface to the cutout parts.

8. The exhaust gas heat exchanger having stacked flat tubes according to claim 7, wherein a folding erection part is provided for an end part of the receiving surface lying on the opposite side of the guide surface; the exchanger, configured such that the folding erection part prevents the cooling water from flying in all directions from the receiving surface and flowing out into the inside of the case.

9. An exhaust gas heat exchanger having stacked flat tubes comprising:

a stacked tube body configured by stacking a plurality of flat tubes in multiple tiers with spaces therebetween and arranged inside a case; the exchanger configured such that exhaust gas flows in from one end part of the stacked tube body in a tube axis direction, circulates through an inside of each flat tube, and flows out from the other end part; and cooling water introduced from a cooling water introduction part provided for the case is supplied to the one end part to circulate along an exterior surface side of each flat tube, wherein the cooling water introduction parts are provided in two locations for the case and introduction directions of the cooling water from each of the cooling water introduction parts into the inside of the case are set in mutually opposite directions so that the cooling water is uniformly distributed over respective opposite end parts of the stacked tube body without drift toward a side of the stacked tube body thereby suppressing local boiling of the cooling water, and wherein each of the introduction directions is parallel to a flat surface of the flat tube in the stacked tube body and vertical in the axis direction of the flat tube.

* * * * *